US008925510B2

(12) United States Patent
Stec et al.

(10) Patent No.: US 8,925,510 B2
(45) Date of Patent: Jan. 6, 2015

(54) AUTOMOTIVE AIR INDUCTION SYSTEM

(75) Inventors: Randall Alan Stec, Canton, MI (US); Michael R. Miller, Livonia, MI (US); Ha To Chung, Canton, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 684 days.

(21) Appl. No.: 12/546,059

(22) Filed: Aug. 24, 2009

(65) Prior Publication Data

US 2010/0147243 A1 Jun. 17, 2010

Related U.S. Application Data

(60) Provisional application No. 61/138,254, filed on Dec. 17, 2008.

(51) Int. Cl.
*F02M 35/10* (2006.01)
*F02M 35/16* (2006.01)
*F02M 35/02* (2006.01)

(52) U.S. Cl.
CPC ... *F02M 35/10013* (2013.01); *F02M 35/10144* (2013.01); *F02M 35/10295* (2013.01); *F02M 35/10301* (2013.01); *F02M 35/161* (2013.01); *F02M 35/02* (2013.01)
USPC ..... 123/184.21; 123/184.61; 285/242; 180/68.1; 180/68.3

(58) Field of Classification Search
USPC ..... 123/184.21, 184.61; 180/68.1, 68.3; 285/242, 330, 422
See application file for complete search history.

(56) References Cited

U.S. PATENT DOCUMENTS

| | | | | | |
|---|---|---|---|---|---|
| 3,720,279 | A * | 3/1973 | Vincenty | 180/68.3 |
| 4,083,586 | A * | 4/1978 | Helm | 285/323 |
| 4,889,081 | A * | 12/1989 | Ozaki | 123/184.53 |
| 5,022,479 | A * | 6/1991 | Kiser et al. | 180/68.3 |
| 5,083,531 | A * | 1/1992 | Gregory et al. | 123/184.21 |
| 5,195,484 | A * | 3/1993 | Knapp | 123/198 E |
| 5,564,513 | A * | 10/1996 | Wible et al. | 180/68.3 |
| 5,769,045 | A * | 6/1998 | Edwards et al. | 123/184.61 |
| 5,794,733 | A * | 8/1998 | Stosel et al. | 180/68.1 |
| 5,806,480 | A * | 9/1998 | Maeda et al. | 123/184.57 |
| 5,921,214 | A * | 7/1999 | Fujita et al. | 123/198 E |
| 5,950,586 | A * | 9/1999 | Ropertz | 123/184.42 |
| 6,116,288 | A * | 9/2000 | Yamamura | 138/118 |
| 6,406,033 | B1 * | 6/2002 | Jessberger | 277/616 |
| 6,684,616 | B2 | 2/2004 | Hornung | |
| 6,840,205 | B2 * | 1/2005 | Sato et al. | 123/184.21 |
| 6,966,292 | B2 * | 11/2005 | Huang | 123/184.21 |

(Continued)

FOREIGN PATENT DOCUMENTS

| | | | | |
|---|---|---|---|---|
| GB | 2037239 A * | 7/1980 | | B60K 13/02 |
| JP | 53041652 | 4/1978 | | |

(Continued)

*Primary Examiner* — Noah Kamen
*Assistant Examiner* — Grant Moubry
(74) *Attorney, Agent, or Firm* — Julia Voutyras; Alleman Hall McCoy Russell & Tuttle LLP

(57) ABSTRACT

An air induction system for an engine of a vehicle, comprising of a conduit configured to convey intake air to the engine; and a fitting arranged at an inlet end of the conduit, the fitting formed from a different material than the conduit, the fitting configured to interface with a structural support element of the vehicle.

18 Claims, 7 Drawing Sheets

(56) References Cited

U.S. PATENT DOCUMENTS

| | | | | |
|---|---|---|---|---|
| 7,069,893 | B2 * | 7/2006 | Cusumano et al. | 123/184.21 |
| 7,237,635 | B2 * | 7/2007 | Khouw et al. | 180/68.3 |
| 7,281,511 | B2 * | 10/2007 | Quezada | 123/184.53 |
| 7,290,630 | B2 * | 11/2007 | Maeda et al. | 180/68.4 |
| 7,415,956 | B1 * | 8/2008 | Prior | 123/184.53 |
| 7,418,994 | B2 * | 9/2008 | Evans et al. | 165/41 |
| 7,556,009 | B2 * | 7/2009 | Niakan et al. | 123/184.21 |
| 7,614,378 | B2 * | 11/2009 | Williams | 123/184.21 |
| 7,685,985 | B2 * | 3/2010 | Madeira | 123/184.21 |
| 7,717,204 | B2 * | 5/2010 | Kondou et al. | 180/68.1 |
| 7,971,565 | B2 * | 7/2011 | Catton et al. | 123/184.61 |
| 7,998,233 | B2 * | 8/2011 | Maeda et al. | 55/385.3 |
| 8,127,878 | B2 * | 3/2012 | Teraguchi et al. | 180/68.3 |
| 2002/0023606 | A1 * | 2/2002 | Schneider | 123/184.21 |
| 2003/0042055 | A1 * | 3/2003 | Suwa et al. | 180/68.3 |
| 2003/0188902 | A1 | 10/2003 | Decuir | |
| 2004/0262061 | A1 * | 12/2004 | Bahr et al. | 180/69.2 |
| 2005/0172924 | A1 * | 8/2005 | Simon | 123/184.23 |
| 2005/0205041 | A1 | 9/2005 | Moenssen et al. | |
| 2005/0215191 | A1 * | 9/2005 | Kino | 454/143 |
| 2006/0137644 | A1 * | 6/2006 | Kino et al. | 123/184.21 |
| 2007/0012276 | A1 * | 1/2007 | Ohara | 123/184.57 |

FOREIGN PATENT DOCUMENTS

| | | | | |
|---|---|---|---|---|
| JP | 60029331 | A * | 2/1985 | |
| JP | 02067451 | A * | 3/1990 | F02M 35/10 |
| JP | 11059204 | A * | 3/1999 | |
| JP | 2003074426 | A * | 3/2003 | |
| JP | 2003254180 | | 9/2003 | |
| JP | 2003314393 | A * | 11/2003 | |
| JP | 2007176200 | A * | 7/2007 | |

* cited by examiner

AUTOMOTIVE AIR INDUCTION SYSTEM

CROSS REFERENCE TO RELATED APPLICATIONS

This application claims the benefit of U.S. Provisional Application 61/138,254, filed on Dec. 17, 2008, entitled AUTOMOTIVE AIR INDUCTION SYSTEM, the entirety of which is hereby incorporated herein by reference for all purposes.

FIELD

The present disclosure relates to an air induction system, and more specifically to an air induction system for an internal combustion engine of an automobile.

BACKGROUND AND SUMMARY

An air induction system is provided which includes a conduit for directing intake air to an internal combustion engine and a fitting that serves as an interface between the conduit and a bolster of a radiator assembly. In at least one embodiment, the fitting is formed from a more flexible material than the conduit to thereby reduce noise, vibration, and harshness (NVH) that may otherwise result from energy transmission between the bolster and the conduit. In at least one embodiment, the fitting includes one or more sealing fins that improve a sealing function between the entrance to the air induction system and the bolster, while also accommodating variability that may be introduced through the manufacturing or installation process. In at least one embodiment, the fitting includes a bellmouth shaped leading edge that improves airflow characteristics of the air induction system by reducing airflow restrictions at the interface between the bolster and the air induction system.

The air induction system described herein provides several advantages over previous approaches to air induction. Some of these advantages include, (1) improved isolation of the air induction system from the body structure of the vehicle through a more flexible fitting to reduce or avoid noise, vibration, and harshness (NVH), (2) a better sealing function at the inlet of the air induction system at the fitting to reduce or prevent hot air recirculation that may degrade the performance of the engine and/or the powertrain cooling system, (3) accommodation of greater manufacturing and assembly variability with respect to the sealing function of the fitting, and (4) reduction air flow restrictions of the air induction system via the bellmouth shaped inlet region.

DETAILED DESCRIPTION

Figure 1:
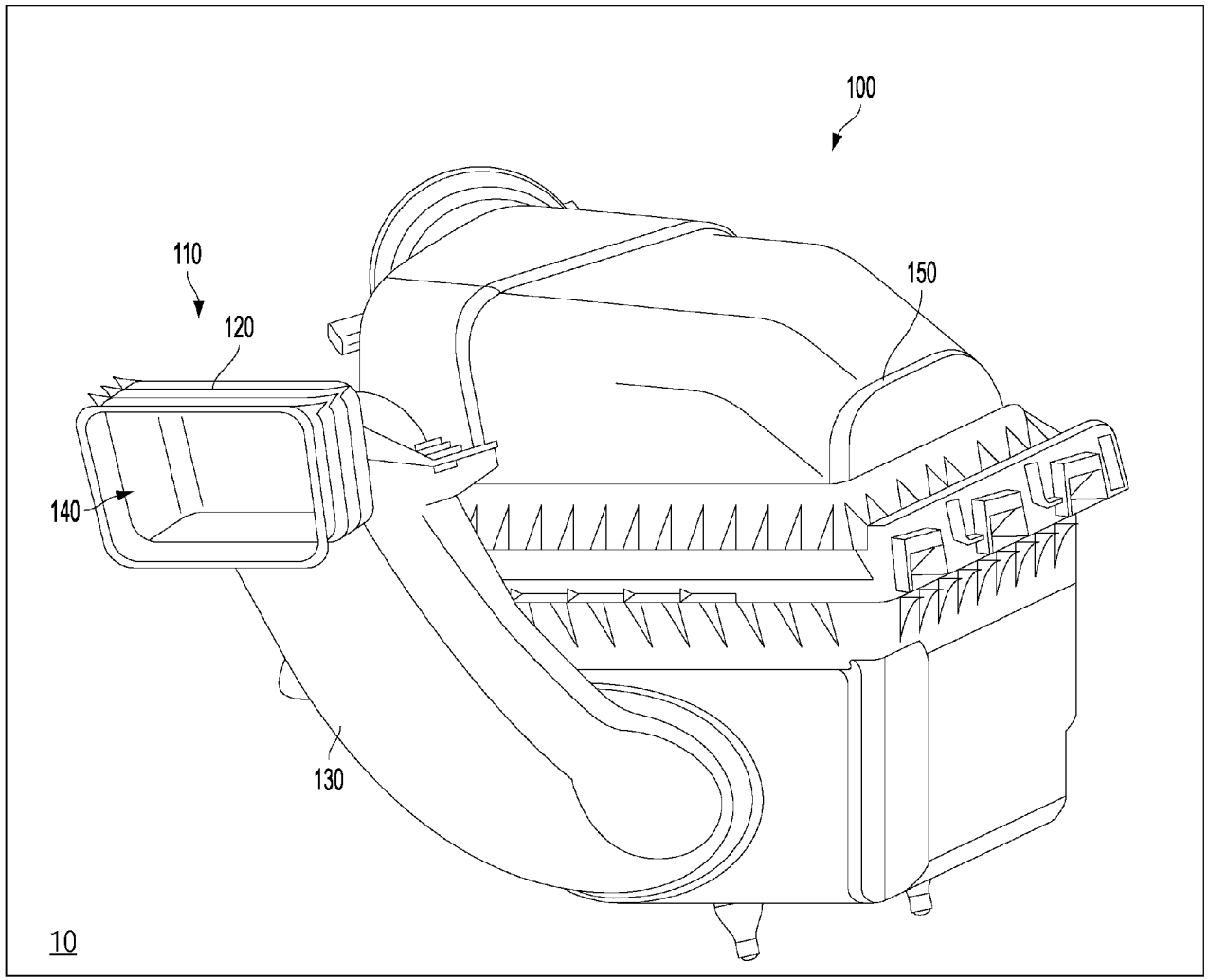
FIG. 1 illustrates an example embodiment of an air induction system of an engine.

FIG. 1 illustrates an example embodiment of an air induction system 100 of an engine 10. Air induction system 100 may include an intake body 110 having an inlet 140 that communicates with air box 150. Intake body 110 may include a fitting 120 and a conduit 130. Air box 150 may communicate with an intake manifold of an internal combustion engine (not shown). In some embodiments, air box 150 may be optionally omitted, whereby conduit 130 communicates directly with an intake manifold of the engine.

Figure 2C:
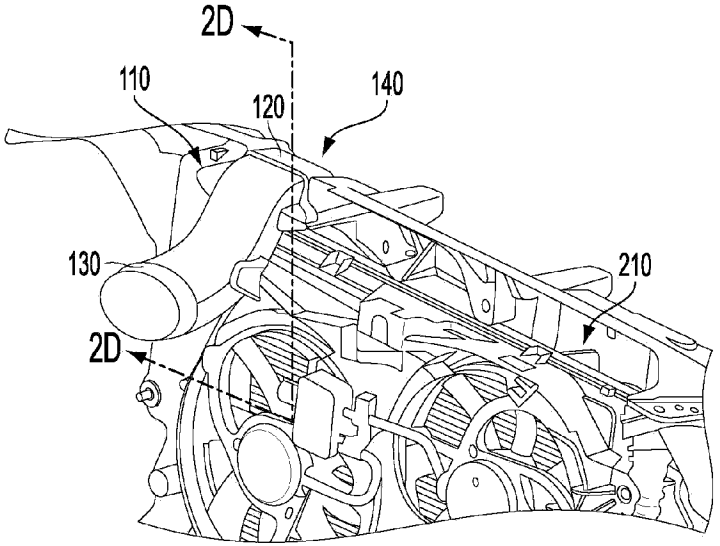
FIGS. 2A-2D illustrate additional views of the air induction system of FIG. 1.
Figure 2D:
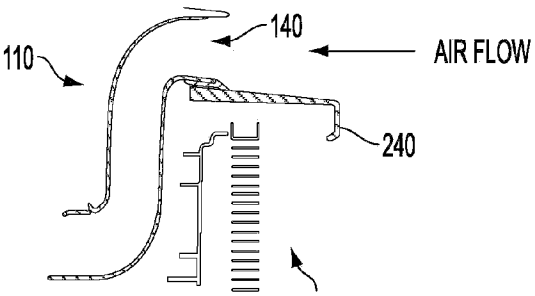
Figure 2A:
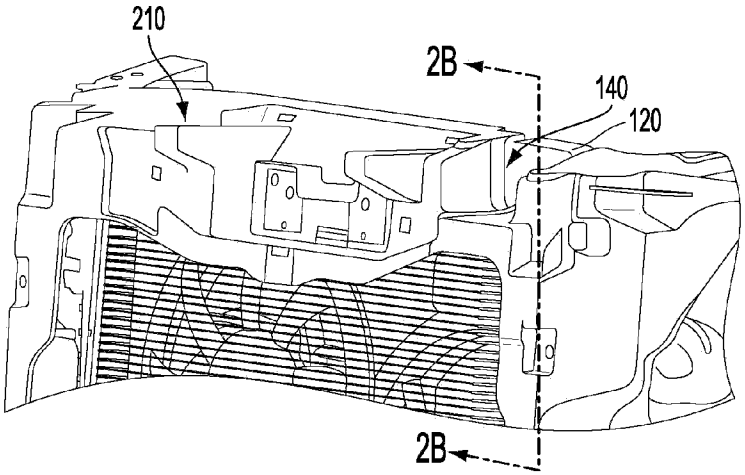
Figure 2B:
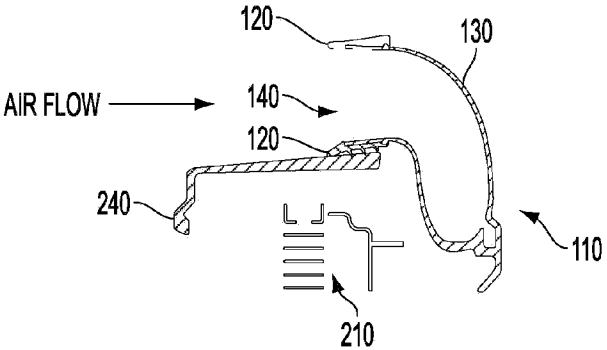

FIGS. 2A-2D illustrate additional views of air induction system 100 in the context of a radiator assembly 210 of an automobile powertrain. Body structure or bolster 240 of radiator assembly 210 is shown interfacing with fitting 120 of intake body 110. FIG. 2A shows a front view of the radiator assembly with inlet 140 provided by fitting 120. FIG. 2B shows a vertical section view of FIG. 2A through intake body 110. FIG. 2C shows a rear view of the radiator assembly and intake body 110 including fitting 120 and conduit 130. FIG. 2D shows a vertical section view of FIG. 2C through intake body 110.

Figure 3B:
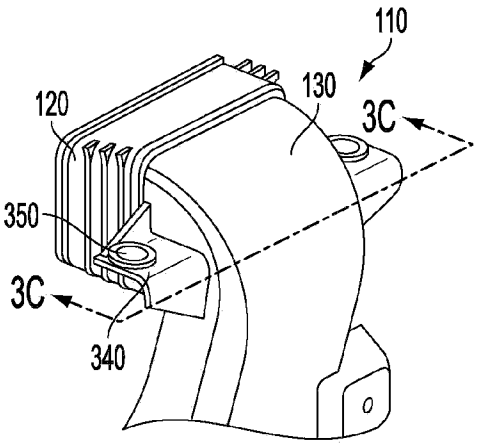
FIGS. 3A-5D illustrate detailed views of an inlet of the air induction system of FIG. 1.
Figure 3C:
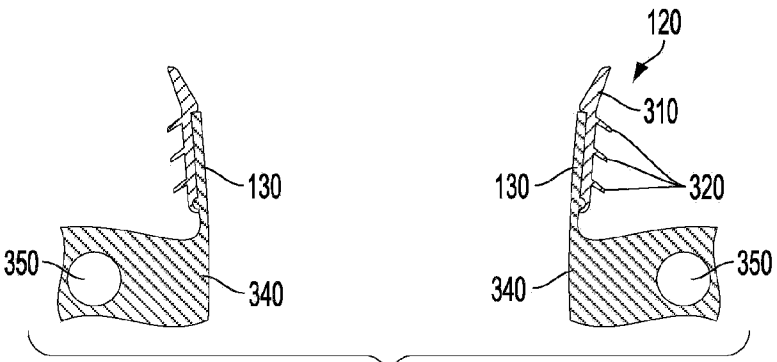
Figure 3A:
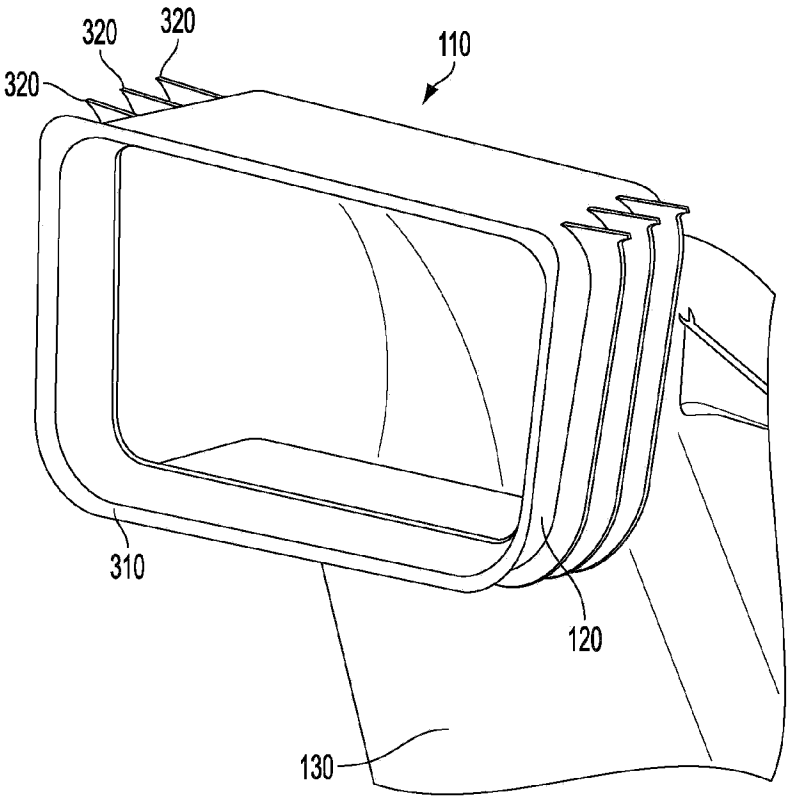

Referring to FIGS. 3A-3C, intake body 110 is shown in greater detail. As shown in FIG. 3A, fitting 120 may include a leading edge or flanged portion 310, which may have a bellmouth shape in at least some embodiments. This bellmouth shape may improve fluid dynamics of the air induction system by reducing the flow restriction at the interface between fitting 120 and body structure 240. The inventors herein have recognized that increased flow restrictions associated with the air induction system may reduce the power output or performance of the engine. As such, a reduction in the flow restrictions of the air induction system may serve to increase the power output (e.g., as measured in horsepower) of the engine to which the air induction system provides intake air.

Figure 6A:
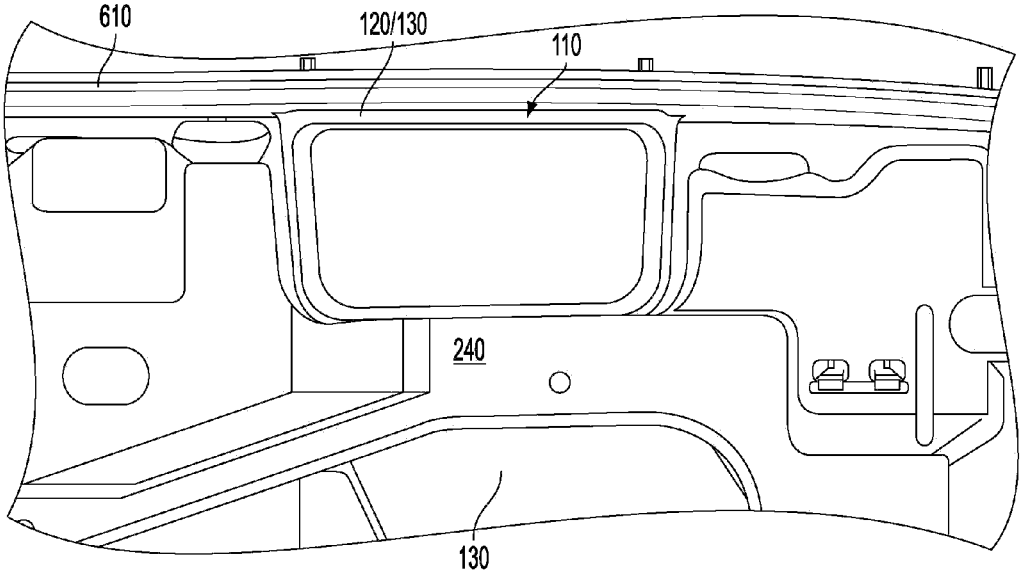
FIGS. 6A-6C illustrates additional views of the air induction system of FIG. 1.
Figure 6B:
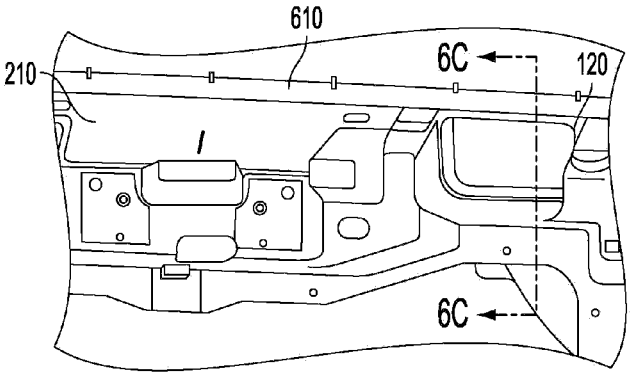
Figure 6C:
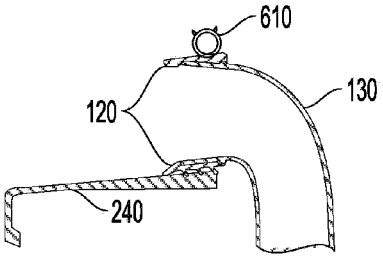

Fitting 120 may also include one or more ribs or sealing fins 320 that protrude radially outward from an outer surface of fitting 120. As shown in FIGS. 3A, 3B, and 3C, fitting 120 may include three sealing fins arranged at different distances from the leading edge. In other embodiments, fitting 120 may include more or less sealing fins. For example, fitting 120 may include 1, 2, 4, 5, 6, or more sealing fins. Furthermore, sealing fins 320 may protrude from the entire outer perimeter or circumference of fitting 120, or may protrude from only a portion of the outer perimeter or circumference of fitting 120. For example, a section view shown in FIG. 2B and FIG. 3A illustrates how the sealing fins may not extend around an upper outer surface of fitting 120 in contrast to the lower outer surface of the fitting that interfaces with body structure or bolster 240. This upper surface may interface with the hood seal as depicted in FIGS. 6A-6C.

FIGS. 3B and 3C further illustrate how conduit 130 may include one or more integrated mounting tabs 340 that extend outward from an outer surface of the conduit. Mounting tabs 340 may include mounting holes 350 for receiving a fastener, which in turn may be secured to body structure 240 of radiator assembly 210. FIG. 3C shows a section view of FIG. 3B through mounting tabs 340 of intake body 110.

Figure 4:
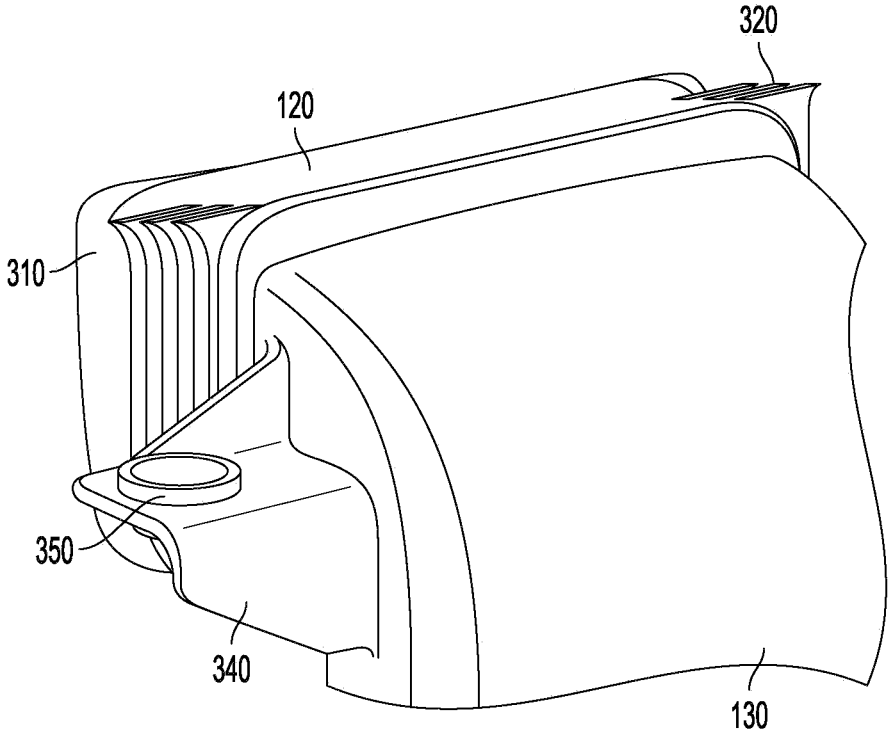

FIG. 4 illustrates another detailed view of intake body 110. In some embodiments, fitting 120 may be formed from a different material than conduit 130. For example, fitting 120 may be formed from a more flexible and less rigid material than conduit 130, which may be formed from a less flexible and more rigid material. As a non-limiting example, fitting 120 may be formed from a rubber or rubber-like material such as Santoprene, while conduit 130 may be formed from a hard plastic or polymer such as Polypropylene. The more flexible material of fitting 120 can provide NVH reduction and isolation between the conduit and the body structure. The less flexible material of conduit 130 can retain its shape when subjected to a vacuum while also providing structural support to the air box.

In some embodiments, fitting 120 may comprise a rubber overmold that is formed over conduit 130. The bellmouth shaped flanged portion, the sealing fins, and the NVH isolating attributes of the fitting may be overmolded (e.g., in rubber or other suitable material) over the conduit material. As such, the intake body may comprise a single element formed by two molding operations that employ different materials. This approach may be used to reduce variability among parts. Hence, intake 110 may be formed from a single unitary combination of fitting 120 and conduit 130, in at least some embodiments. It should be appreciated that in other embodiments, fitting 120 and conduit 130 may be formed from the same or similar material in some embodiments, while in some embodiments the fitting and conduit may be fastened together via any suitable fasteners or press fit.

Figure 5A:
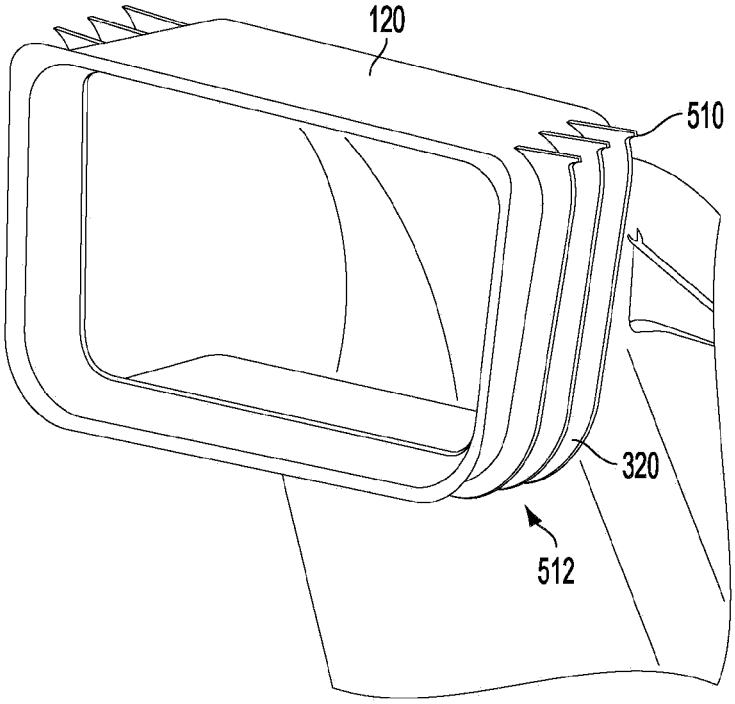
Figure 5B:
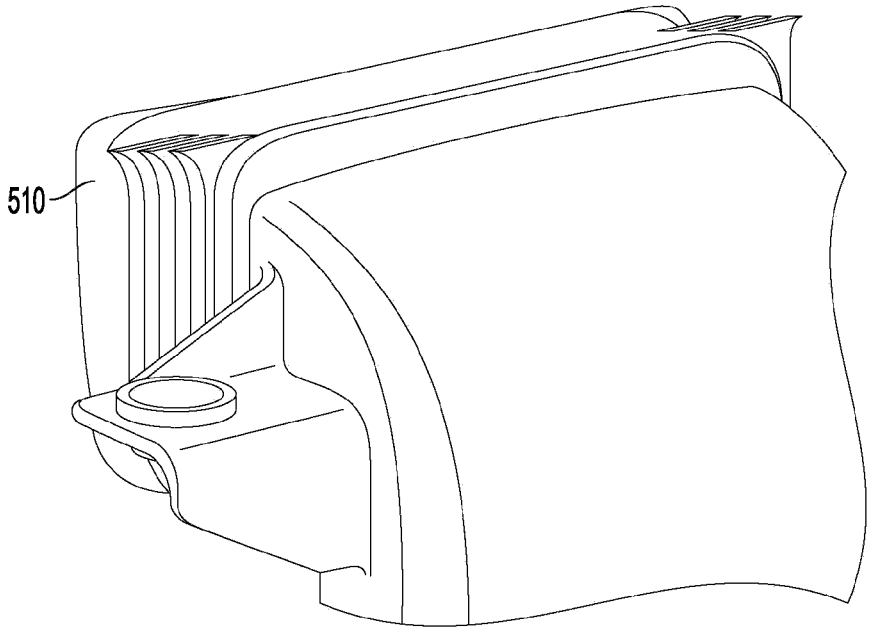
Figure 5C:
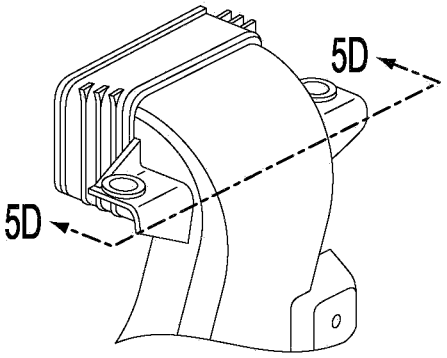
Figure 5D:
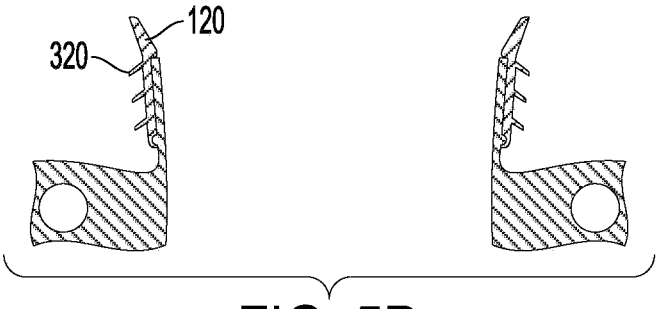

FIGS. 5A-5D illustrate other detailed views of intake body 110. In some embodiments, sealing fins 320 may include corners or ears at their outer edges. For example, as shown in FIGS. 5A and 5B, sealing fins 320 include ears 510 at the upper right and left edges, while the lower right and left edges of the sealing fins include a larger radius of curvature as indicated at 512. In some embodiments, these sealing fins and their associated corners may be contoured to match the corresponding shape of the bolster's radius (shown in FIGS. 6A-6C). It should be appreciated that these corners may be eliminated from the sealing fins in some embodiments, while in other embodiments, the lower right and left edges of the sealing fins included at 512 may include these corners.

Furthermore, in some embodiments, the sealing fins may be swept or curved relative to the outer face of fitting 120. For example, as shown in the section view provided depicted by FIG. 5D, sealing fins 320 may be swept away from the inlet of the intake body. This curvature or swept configuration enables the sealing ribs to fold or deform during installation to thereby ease assembly and to better retain the intake body between the bolster and the hood seal once installed. It should be appreciated that in some embodiments, one or more of the fins may be swept toward the inlet of the intake body, or may protrude at an angle that is normal to the outer surface of fitting 120.

Sealing fins 320 may be spaced apart to accommodate a suitable amount of assembly variability in one or more of the three coordinate directions while still providing an ample seal at the interface of the intake body with the bolster and hood seal. In some embodiments, the sealing fins may be spaced apart from each other at equal distances, while in other embodiments the sealing fins may be spaced apart at different distances from each other.

FIGS. 6A-6C illustrates additional views of the air induction system 100 with hood seal 610 installed. As shown in FIG. 6, a top edge of fitting 120, including flanged portion 310, serves as a top edge of the bolster that interfaces with hood seal 610 and fills the radius of the bolster as shown in greater detail by the section view of FIG. 6C. Thus, FIG. 6 shows intake body 110 in an installed configuration where fitting 120 is nestled between the surfaces of bolster 240 and hood seal 610.

In some conditions, a phenomenon referred to as "rise over ambient" (ROA) temperature at the throttle body (e.g., downstream of conduit 130) may cause loss in engine torque and thus degradation of vehicle performance. To address this issue and other issues, air induction system 100 may be provided to supply cooler air to the engine. As described above, this air induction system may be configured to receive air from outside the engine compartment of the vehicle, thereby reducing the amount of heated air that is inducted from the engine compartment.

Air induction system 100 is described in the context of an automotive application, where air induction system is configured to entrain air from in front of or in parallel with the radiator through the front grill of the vehicle. For example, as shown in FIGS. 1-6, the inlet of the air induction system is configured to pass through the structural front bolster, which provides support for the radiator. However, it should understood that the air induction system described herein may be provided to entrain air from other suitable locations.

The invention claimed is:

1. An air induction system for an engine, comprising:

a conduit configured to convey intake air to the engine; and a fitting having an entire outer perimeter arranged at an inlet end of the conduit over and entirely around an outer surface of the conduit, the fitting formed from a more flexible material than the conduit, an outer surface of the fitting nestled between and interfacing with a radiator bolster element and hood seal of the vehicle, the fitting separate from the radiator bolster element.

2. The air induction system of claim 1, where the fitting is overmolded onto the conduit to form a unitary intake body for the engine and where the fitting serves as an interface between the radiator bolster element and the conduit.

3. The air induction system of claim 2, where the fitting includes a leading edge defining an inlet, and where the leading edge includes a tapered or bellmouth shape that extends outward from an outer surface of the fitting.

4. The air induction system of claim 1, where the fitting includes one or more sealing fins that protrude from the outer surface of the fitting and interface with the radiator bolster element.

5. The air induction system of claim 4, where the fitting includes at least three sealing fins that are parallel and spaced apart from each other in a flow direction and protrude from the outer surface of the fitting at least along two or more sides of the fitting, the fins being swept away from an outer inlet face of the fitting.

6. The air induction system of claim 5, where the one or more sealing fins protrude from a lower outer surface of the fitting and engage with the radiator bolster element, where the one or more sealing fins extend around three sides of an outer circumference of the fitting, where the one or more sealing fins do not extend around the upper outer surface of the fitting, the upper outer surface of the fitting being flat, and where the one or more sealing fins include ears at upper right and left edges of the one or more sealing fins and a larger radius of curvature at lower right and left edges of the one or more sealing fins, the upper right and left edges at a side of the fitting that interfaces with the hood seal.

7. The air induction system of claim 1, where a lower outer surface of the fitting interfaces with the radiator bolster element and an upper outer surface of the fitting interfaces with the hood seal and where only solid material without spaces is between the conduit and the hood seal.

8. An air induction system for an engine, comprising:

a bolster including a radiator assembly;

a hood seal;

a fitting including an air inlet arranged between a portion of the bolster at a lower outer surface of the fitting and the hood seal at an upper outer surface of the fitting, where the fitting and the bolster are separate elements; and a conduit coupled with the fitting, the conduit configured to convey intake air received via the air inlet of the fitting to the engine, the fitting formed from a more flexible material than the conduit, where solid material without spaces is between the conduit and the hood seal, the fitting providing sealing around an entire outer perimeter of the fitting via one or more sealing fins and the upper outer surface of the fitting, the entire outer perimeter of the fitting arranged entirely around an outer surface of the conduit.

9. The air induction system of claim 8, where the fitting is overmolded onto the conduit to form a unitary intake body for the engine.

10. The air induction system of claim 8, where the fitting includes a leading edge defining an inlet, and where the leading edge includes a tapered or bellmouth shape.

11. The air induction system of claim 8, where the one or more sealing fins extend around three sides of the outer perimeter of the fitting and protrude from an outer surface of the fitting.

12. The air induction system of claim 11, where the fitting includes at least three sealing fins that are spaced apart from each other in a flow direction and protrude from the outer surface of the fitting along three sides of the fitting that interface with the bolster, the at least three sealing fins having parallel surfaces relative to one another; and where the at least three sealing fins do not protrude from the outer surface of the fitting along a side of the fitting that interfaces with the hood seal.

13. A system for a vehicle, comprising:

an engine having an air induction system including a bolster including a radiator assembly, a hood seal arranged along an upper surface of the bolster, a fitting separate from the bolster, the fitting including an air inlet nestled between a portion of the bolster and the hood seal, the fitting including one or more sealing fins interfacing with a surface of the bolster at a lower outer surface of the fitting and the fitting interfacing with a surface of the hood seal at an upper outer surface of the fitting, and a conduit coupled with the fitting, the conduit configured to convey intake air received via the air inlet of the fitting to an air box en route to the engine, the fitting comprising a different material than the conduit, the fitting having an entire outer perimeter arranged over and entirely around an outer surface of the conduit and formed from a more flexible material than the conduit, the hood seal also arranged along an upper surface of the fitting, where there is solid material between the conduit and hood seal without spaces.

14. The air induction system of claim 13, where the fitting is overmolded onto the conduit to form a unitary intake body for the engine.

15. The air induction system of claim 13, where the conduit is formed from a more rigid material as compared to the fitting and where the fitting is positioned between the conduit and the bolster.

16. The air induction system of claim 13, where the fitting includes a leading edge defining an inlet, and where the leading edge includes a tapered or bellmouth shape.

17. The air induction system of claim 13, where the one or more sealing fins protrude from an outer surface of the fitting, the sealing fins including ears at upper right and left edges of the sealing fins and a larger radius of curvature at lower right and left edges of the sealing fins, the upper right and left edges at a side of the fitting that interfaces with the hood seal.

18. The air induction system of claim 17, where the fitting includes at least three sealing fins that are spaced apart from each other in a flow direction and protrude from the outer surface of the fitting on only a bottom and two sides of the fitting that interface with the bolster; and where the at least three sealing fins do not protrude from the outer surface of the fitting along the side of the fitting that interfaces with the hood seal.

* * * * *